US006562221B2

(12) United States Patent
Crotty

(10) Patent No.: US 6,562,221 B2
(45) Date of Patent: May 13, 2003

(54) PROCESS AND COMPOSITION FOR HIGH SPEED PLATING OF TIN AND TIN ALLOYS

(76) Inventor: David Crotty, 31 Woodside Park Blvd., Pleasant Ridge, MI (US) 48069

( * ) Notice: Subject to any disclaimer, the term of this patent is extended or adjusted under 35 U.S.C. 154(b) by 0 days.

(21) Appl. No.: 09/965,743

(22) Filed: Sep. 28, 2001

(65) Prior Publication Data

US 2003/0070933 A1 Apr. 17, 2003

(51) Int. Cl.[7] ..... C25D 3/32

(52) U.S. Cl. ..... 205/254; 205/140; 205/302; 205/303

(58) Field of Search ..... 205/140, 154, 205/253, 254, 301, 302, 303, 304; 106/1.22, 1.25

(56) References Cited

U.S. PATENT DOCUMENTS

| | | | | |
|---|---|---|---|---|
| 3,749,649 | A | | 7/1973 | Valayil |
| 3,769,182 | A | | 10/1973 | Beckwith et al. |
| 3,905,878 | A | | 9/1975 | Dohi et al. |
| 4,118,289 | A | | 10/1978 | Hsu |
| 4,565,610 | A | | 1/1986 | Nobel et al. |
| 4,617,097 | A | | 10/1986 | Nobel et al. |
| 5,064,512 | A | * | 11/1991 | Brodalla et al. ..... 205/202 |
| 5,266,103 | A | * | 11/1993 | Uchida et al. ..... 106/122 |
| 5,587,063 | A | * | 12/1996 | Kuhm et al. ..... 205/173 |
| 6,030,516 | A | * | 2/2000 | O'Driscoll ..... 205/302 |
| 6,217,738 | B1 | | 4/2001 | O'Driscoll |
| 6,248,228 | B1 | | 6/2001 | Gillman et al. |
| 6,322,686 | B1 | * | 11/2001 | Brown et al. ..... 205/253 |
| 6,372,117 | B1 | * | 4/2002 | Tamura ..... 205/241 |

OTHER PUBLICATIONS

F.A. Lowenheim, Electroplating, McGraw–Hill Book Co., New York, pp 389–391, 1978.*

* cited by examiner

*Primary Examiner*—Roy King
*Assistant Examiner*—William T. Leader
(74) *Attorney, Agent, or Firm*—Carmody & Torrance LLP

(57) ABSTRACT

A composition and process for electroplating tin or tin alloys onto a substrate at relatively high current densities. The electrolyte comprises toluene sulfonic acid and a source of ammonium ions and/or magnesium ions. The process is particularly suited to high speed reel to reel or strip steel plating.

12 Claims, No Drawings

PROCESS AND COMPOSITION FOR HIGH SPEED PLATING OF TIN AND TIN ALLOYS

BACKGROUND OF THE INVENTION

This invention relates to electrolyte compositions suitable for electroplating surfaces with tin and/or tin alloys at relatively high production speeds.

In general, it is preferred for a plating process to exhibit as many of the following properties as possible in order to achieve optimum plating results: capability of plating across a wide range of current densities including high current densities necessary for high throughput, production of good quality metallic deposits which are acceptable in appearance and physical properties, an electrolyte with low corrosivity and high conductivity, and a process that is relatively friendly to human health and the environment. As would be expected, available plating processes accomplish the foregoing goals to varying extents.

A variety of plating solutions are known for electroplating tin and tin alloys. Typical plating solutions include aqueous acidic baths based upon fluoroborate and fluorosilicate as described in U.S. Pat. Nos. 3,769,182 and 4,118,289, the teachings each of which are incorporated herein by reference in their entirety. In the alternative, electroplating baths have been formulated based upon aryl or alkyl sulfonic acids. The arylsulphonic acid of choice in this regard has been phenolsulfonic acid as described in U.S. Pat. No. 3,905,878, the teachings of which are incorporated by reference in their entirety. More recently, methanesulfonic acid has been used as a specific preferred example of an alkane sulfonic acid in combination with a number of brightening agents for use in the electroplating of tin, lead and tin-lead alloys as described in U.S. Pat. Nos. 4,565,610 and 4,617,097, the teachings each of which are incorporated herein by reference in their entirety. However systems based upon phenol sulfonic acid have proven relatively highly toxic and have odor problems and systems based upon methane sulfonic acid suffer from high costs.

Various addition agents have been proposed which enhance the quality of the plate produced from the foregoing electrolyte solutions. These additives can include condensates of hydrophobic organic compounds with alkylene oxides such as alpha napthol 6 mole ethoxylate, alkyl benzene alkoxylates, 2-alkylimidazolines, aromatic aldehydes such as naphthaldehyde, derivatives of 2,2-bis (4-hydroxy phenyl) propane, and substituted phenols. In this regard, please refer to U.S. Pat. Nos. 6,217,738 and 6,248,228, the teachings each of which are incorporated herein by reference in their entirety.

Large volumes of such tin and tin alloy plating solutions are used to plate steel substrates in a continuous manner in what is called strip plating. In this case it is particularly important to have a plating system which is capable of giving satisfactory results over a wide range of current densities in order to accommodate large variations in production speed.

It is therefore an object of this invention to provide a plating process which is capable of plating over a wide range of current densities while at the same time presenting the advantages of relatively low cost and toxicity. These and other objects are accomplished by preparing electroplating baths in accordance with the teachings disclosed herein.

SUMMARY OF THE INVENTION

The inventor herein proposes a process for plating tin or tin alloys, said process comprising contacting a substrate with a plating composition comprising:

1. a source of tin ions;
2. toluene sulfonic acid; and
3. a source of ammonium ions, magnesium ions or a combination of the foregoing;

and applying an electrical current such that the substrate becomes a negative electrode in the composition.

In addition to the foregoing, the plating composition may also comprise metallic ions other than tin in order to produce a tin-alloy plate and will also preferably comprise known plating performance additives such as brighteners, levelers and other additives that optimize the performance of the plating composition.

DETAILED DESCRIPTION OF THE INVENTION

The inventors herein have discovered a way to formulate a plating solution for tin and tin alloys using an electrolyte that is based upon toluene sulfonic acid. Previous attempts to use toluene sulfonic acid have encountered difficulties because of the low solubility of toluene sulfonic acid and the resulting relatively low conductivity of the solution. However the inventors have discovered that by combining, in aqueous solution, toluene sulfonic acid with ammonium salts and/or magnesium salts, the solubility of the toluene sulfonic acid can be increased substantially, the conductivity of the solution can also be increased and excellent plating results can be achieved.

Thus the inventor herein proposes a process for plating tin or tin alloys, said process comprising contacting a substrate with a plating composition comprising:

1. a source of tin ions;
2. toluene sulfonic acid;
3. a material selected from the group consisting of sources of ammonium ions, sources of magnesium ions, and combinations of the foregoing;

and applying an electrical potential to said substrate such that said substrate is a negative electrode in said plating composition. If the plating composition is intended to plate a tin alloy, then it will also comprise metallic ions corresponding to the desired alloying element(s). The plating composition will also preferably comprise known plating performance additives that improve the appearance and physical properties of the deposit as well as efficiency with which the plating composition plates.

The source of tin should be a source of stannous tin ions. Suitable tin sources include stannous sulfate, stannous chloride, stannous methane sulfanate, stannous fluoroborate and combinations of the foregoing. The concentration of tin in the plating composition may range from 10 to 200 g/l but is preferably from 30 to 90 gl.

Toluene sulfonic acid is a necessary component of the electrolyte in the plating composition of this invention. The concentration of toluene sulfonic acid in the plating composition may range from 10 to 150 g/l but is preferably from 40 to 90 g/l. These concentrations cannot normally be achieved without the presence of ammonium and/or magnesium ions in the solution.

The plating composition must also comprise a source of ammonium ions and/or a source of magnesium ions. These ions provide several advantages including (i) increasing the solubility of toluene sulfonic acid in the plating composition, (ii) increasing the conductivity of the plating composition and (iii) enhancing the overall efficiency and plating performance of the process. Sources of ammonium ions include ammonium salts such as ammonium sulfate, ammonium chloride, ammonium fluoride, ammonium hydroxide and ammonium bifluoride. Ammonium sulfate is a preferred source of ammonium ions. Sources of magnesium ions include magnesium salts such as magnesium sulfate, magnesium hydroxide and magnesium chloride. Magnesium sulfate is a preferred source of magnesium ions. In general magnesium salts are preferred over ammonium salts for environmental concerns, but ammonium salts are preferred over magnesium salts because the ammonium salts generally exhibit higher solubility and do not tend to crystallize out of solution at cool temperatures. The total concentration of ammonium ions and/or magnesium ions in the plating composition may range from 3 to 50 g/l but is preferably from 10 to 15 g/l.

The plating composition may be used to plate tin or tin alloys. If tin alloy plating is desired then the plating composition should also comprise a source of metal ions corresponding to the alloying element(s). Suitable alloying elements include zinc, lead, copper, bismuth and nickel. If alloy plating is desired soluble sources of the foregoing metals such as nickel sulfate, copper sulfate, zinc sulfate, bismuth sulfate and lead methane sulfonate, may be employed. The concentration of the alloying element in the plating composition will range depending upon the alloy content desired in the plated deposit but is preferably from about 0.5 to 50 g/l.

The plating composition may also preferably comprise antioxidants which retard the oxidation of divalent tin to tetravalent tin. Typical antioxidants have been described for example in U.S. Pat. No. 3,749,649 and include 1, 2, 3-trihydroxy benzene, 1,2-dihydroxybenzene, 1,2-dihydroxybenzene 4-sulfonic acid, 1,2 dihydroxybenzene-3,5-disulfonic acid, 1,4 dihydroxybenzene, and vanadium pentoxide.

The plating composition may also preferably comprise known plating performance additives such as those described in U.S. Pat. No. 6,217,738, the teachings of which are incorporated by reference herein in their entirety. As disclosed therein these plating performance additives may include certain mono-, di-or tri-substituted phenols. These substituted phenols may have at least one substituent containing at least one secondary, tertiary, or quaternary nitrogen atom, and are said to improve the appearance and physical properties of the plate and the overall plating performance of the process. In addition to the substituted phenols or in replacement thereof, surfactants and/or water soluble polymers may also be employed as plating performance additives. Preferably the concentration of plating performance additives in the plating composition will range from about 0.5 to 20 g/l.

In order to operate the process, the components of the plating composition are combined. The substrate to be plated is then immersed in the plating composition and an electrical potential is applied such that the substrate become a negative electrode in the plating composition. Preferably the temperature of the plating composition is maintained between about 90° F. and 150° F. The inventors have found that the plating process may effectively plate current densities ranging from about 50 to 1000 amps per square foot of substrate.

This invention is further described by the following examples which should be taken as illustrative only and not limiting in any way.

EXAMPLE I (COMPARATIVE)

A plating bath is prepared using 110 gm/L of stannous sulfate and 10% v/v of methane sulfonic acid (MSA). A brightener was added at 3% of bath volume. The composition of the foregoing brightener included materials described in U.S. Pat. No. 6,217,738 mixed with nonionic wetting agents. The resulting bath contains about 60 gm/L of stannous tin ions and has an acidity of 2.2 N as titrated standardized sodium hydroxide solution. A brass cylinder that is 12 mm in diameter and 7 mm tall is fitted on a fixture that is designed to fit into a Pine Instruments ASR rotator. The brass cylinder is cleaned using conventional procedures, placed in the fixture and rotated at about 244 RPM that simulates a coil of brass moving through the reel to reel plating cell at about 0.8 M/min (30 ft/min). The plating bath is operated at 50–60° C. The rotating cylinder is plated for times and currents as described in Table 1 to simulate operation at a wide range of current densities.

TABLE 1

| Test | Time | Current | Current Density |
|---|---|---|---|
| 1 | 30 sec | 0.33 A | 10 ASD |
| 2 | 15 sec | 1.00 A | 30 ASD |
| 3 | 10 sec | 1.66 A | 50 ASD |

The voltage required to obtain the desired current, the appearance and the resulting plating rates are shown in Table 2. While the appearance of the deposit was acceptable at 10 ASD, the deposit of the 30 and 50 samples were somewhat rough.

EXAMPLE II (COMPARATIVE)

A plating bath is prepared with 60 gm/L of stannous sulfate and 30 gm/L of toluene sulfonic acid (TSA). The same 3% dose of the same brightener was added to the bath. The resulting bath contains 30 gm/L stannous tin and has an Acidity of 1.ON. These amounts of TSA and stannous tin ions are about the maximum solubile concentration for these materials together. The brass cylinders were plated as described in Example 1. The results of the test are listed in Table 2. Because the TSA is not as acidic as MSA the voltage required to reach 10 and 30 ASD are much higher than with the MSA bath. The 50 ASD sample could not be plated because the capacity of the power source would be exceeded.

EXAMPLE III (COMPARATIVE)

A plating bath is prepared with 60 gm/L of stannous sulfate, 30 gm/L of toluene sulfonic acid and 30 gm/L of concentrated sulfuric acid. The same 3% dose of the same brightener was added to this bath. The resulting bath contains 30 gm/L of stannous tin and has an acidity of 2. ON. As with Example 2 these concentrations represent about the highest soluble concentrations of this mixture. The brass cylinders were plated as described in Example 1. The results of the test are listed in Table 2. While the 10 ASD sample was acceptable, the 30 and 50 ASD samples were somewhat rough in appearance.

EXAMPLE IV

A plating bath is prepared with 110 gm/L of stannous sulfate, 60 gm/L of toluene sulfonic acid, 60 gm/L of magnesium sulfate, and 30 gm/L of concentrated sulfuric acid. The same 3% dose of the same brightener was added to this bath. The resulting bath contains 60 gm/L of stannous tin as has an acidity of 2.2 N. The stannous tin and the TSA are very soluble in this combination at operating temperatures. The brass cylinders were plated as described in Example 1. The results of the test are listed in Table 2. The three samples run at 10, 30 and 50 ASD are acceptable in appearance.

TABLE 2

RESULTS OF EXAMPLES

| Example | Amps | Volts | ASD | Plating Rate Um/min | Appearance |
|---|---|---|---|---|---|
| 1 | 0.33 | 3.0 | 10 | 4.5 | Ok |
| | 1.00 | 5.0 | 30 | 7.9 | Rough |
| | 1.66 | 6.0 | 50 | 7.9 | Rough |
| 2 | 0.33 | 5.0 | 10 | 4.9 | OK |
| | 1.00 | 10.0 | 30 | 6.9 | Rough |
| | 1.66 | ND | ND | ND | ND |
| 3 | 0.33 | 3.5 | 10 | 4.6 | Ok |
| | 1.00 | 6.0 | 30 | 6.2 | Matte Ok |
| | 1.66 | 7.5 | 50 | 8.6 | Rough |
| 4 | 0.33 | 3.5 | 10 | 4.8 | Ok |
| | 1.00 | 5.5 | 30 | 6.2 | Matte Ok |
| | 1.66 | 7.5 | 50 | 8.9 | Matte Ok |

I claim:

1. A composition for electroplating tin or tin alloys onto a substrate said composition comprising:

a). a source of tin ions;

b). toluene sulfonic acid;

c). a material selected from the group consisting of sources of ammonium ions, sources of magnesium ions and combinations of the foregoing, wherein the concentration of ammonium ions and magnesium ions in the aggregate is from about 3 to 50 g/l; and d). at least one plating performance additive selected from the group consisting of mono-, di-, or tri- substituted phenols having at least one substituent containing at least one secondary, tertiary or quaternary nitrogen atom.

2. A composition according to claim 1 wherein the material is selected from the group consisting of ammonium sulfate, magnesium sulfate and combinations of the foregoing.

3. A composition according to claim 1 wherein the composition also comprises a soluble source of an alloying element selected from the group consisting of zinc, lead, copper, bismuth, nickel and combinations of the foregoing.

4. A composition according to claim 3 wherein the material is selected from the group consisting of ammonium sulfate, magnesium sulfate and combinations of the foregoing.

5. A composition according to claim 3 wherein the concentration of toluene sulfonic acid is from 10 to 150 g/l.

6. A composition according to claim 1 wherein the concentration of toluene sulfonic acid is from about 10 to 150 g/l.

7. A process for electroplating tin or tin alloys onto a substrate said process comprising contacting the substrate with a composition comprising:

a). a source of tin ions;

b). toluene sulfonic acid;

c). a material selected from the group consisting of sources of ammonium ions, sources of magnesium ions and combinations of the foregoing, wherein the concentration of ammonium ions and magnesium ions in the aggregate is from about 3 to 50 g/l; and d). at least one plating performance additive selected from the group consisting of mono-, di-, or tri- substituted phenols having at least one substituent containing at least one secondary, tertiary or quaternary nitrogen atom; and applying an electrical potential such that the substrate becomes a negative electrode in the composition.

8. A process according to claim 7 wherein the material is selected from the group consisting of ammonium sulfate, magnesium sulfate and combinations of the foregoing.

9. A process according to claim 7 wherein the composition also comprises a soluble source of an alloying element selected from the group consisting of zinc, lead, copper, bismuth, nickel and combinations of the foregoing.

10. A process according to claim 9 wherein the material is selected from the group consisting of ammonium sulfate, magnesium sulfate and combinations of the foregoing.

11. A process according to claim 9 wherein the concentration of toluene sulfonic acid is from about 10 to 150 g/l.

12. A process according to claim 7 wherein the concentration of toluene sulfonic acid is from about 10 to 150 g/l.

* * * * *